US010844573B2

(12) United States Patent
Costner, III et al.

(10) Patent No.: US 10,844,573 B2
(45) Date of Patent: Nov. 24, 2020

(54) MOUNTING ASSEMBLY

(71) Applicant: Caterpillar Inc., Deerfield, IL (US)

(72) Inventors: James David Costner, III, Decatur, IL (US); David L. Cox, Monticello, IL (US)

(73) Assignee: Caterpillar Inc., Peoria, IL (US)

( * ) Notice: Subject to any disclaimer, the term of this patent is extended or adjusted under 35 U.S.C. 154(b) by 209 days.

(21) Appl. No.: 16/039,497

(22) Filed: Jul. 19, 2018

(65) Prior Publication Data

US 2020/0024822 A1 Jan. 23, 2020

(51) Int. Cl.
*E02F 3/815* (2006.01)
*E02F 3/76* (2006.01)

(52) U.S. Cl.
CPC ..... *E02F 3/8152* (2013.01); *E02F 3/7668* (2013.01); *E02F 3/7672* (2013.01)

(58) Field of Classification Search
CPC ..... E02F 3/8152; E02F 3/7672; E02F 3/7668
See application file for complete search history.

(56) References Cited

U.S. PATENT DOCUMENTS 3,463,243 A * 8/1969 Fisher ..... E02F 3/8157 172/781
4,074,767 A * 2/1978 Cole ..... E02F 3/764 172/741
4,105,078 A 8/1978 Gilbert
5,076,370 A 12/1991 Stubben et al.
6,585,059 B2 7/2003 Michael, Jr. et al.
7,650,949 B1 1/2010 Horstman
8,316,956 B2 11/2012 Horstman et al.
9,809,950 B2 11/2017 Zimmerman et al.
2002/0170724 A1* 11/2002 McGugan ..... E02F 3/8157 172/781
2003/0042029 A1* 3/2003 Michael, Jr. ..... E02F 3/7636 172/781
2006/0070758 A1* 4/2006 Ryan ..... E02F 3/7654 172/781
2006/0130305 A1 6/2006 Englot
2008/0138154 A1* 6/2008 Horstman ..... E02F 3/3604 404/101
2018/0106013 A1 4/2018 Cox et al.
2019/0177949 A1* 6/2019 Harshman ..... E02F 3/815

* cited by examiner

*Primary Examiner* — Jessica H Lutz
(74) *Attorney, Agent, or Firm* — Oblon, McClelland, Maier & Neustadt

(57) ABSTRACT

A mounting assembly for a blade of a motor grader includes a mounting bracket having a groove, at least one first bore, and a second bore. The mounting assembly includes a wear element disposed in the groove. The wear element includes at least one recess. The wear element is adapted to slidably receive a portion of the blade thereon. The mounting assembly also includes a retention pin disposed in the at least one first bore. The retention pin includes an aperture provided therein. The retention pin is adapted to engage the at least one recess provided on the wear element to limit longitudinal movement of the wear element within the groove. The mounting assembly further includes a lynch pin disposed in each of the second bore and the aperture to limit axial movement of the retention pin within the at least one first bore.

20 Claims, 4 Drawing Sheets

MOUNTING ASSEMBLY

TECHNICAL FIELD

The present disclosure relates to a mounting assembly. More particularly, the present disclosure relates to a mounting assembly for a blade of a motor grader.

BACKGROUND

Grader machines, often referred to as motor graders, are typically used to displace, distribute, mix, and grade a material, such as soil, over a work surface. Grader machines commonly employ a blade or moldboard to carry out one or more of these functions. Some machines may provide for lateral movement of the blade, thereby allowing the blade to assume various work-related positions relative to the work surface.

Commonly, a wear strip is employed between a mounting member and the blade for the blade to slide against. As the wear strip may wear out, a new wear strip may have to be provided between the mounting member and the blade. However, replacement of the wear strip may be a laborious and time intensive process due to complex mounting arrangements around the wear strip. Further, conventional systems provide limited visibility of the wear strip, thereby obstructing visual inspection of the wear strip. Hence, there is a need for an improved mounting assembly for such applications.

U.S. Pat. No. 7,650,949 describes a work vehicle having a moldboard support and a moldboard mounted to the moldboard support. The moldboard includes a blade and a sideshift rail. The sideshift rail includes a bar attached to the blade and a wear strip removably mounted to, and extending along, the bar so as to cover at least a portion of the bar. The wear strip contacts the moldboard support for slidable movement against the moldboard support upon sideshifting of the moldboard relative to the moldboard support. The wear strip is fastened to the bar with at least one fastener.

SUMMARY OF THE DISCLOSURE

In an aspect of the present disclosure, a mounting assembly for a blade of a motor grader is provided. The mounting assembly includes a mounting bracket adapted to be mounted to a frame of the motor grader. The mounting bracket includes a groove extending along a longitudinal axis of the mounting bracket. The mounting bracket also includes at least one first bore provided adjacent to the groove. The mounting bracket further includes a second bore provided adjacent to the at least one first bore. The mounting assembly includes a wear element disposed in the groove. The wear element includes at least one recess provided thereon. The at least one recess is adapted to be axially aligned with respect to the at least one first bore provided in the mounting bracket. The wear element is adapted to slidably receive a portion of the blade thereon. The mounting assembly also includes a retention pin disposed in the at least one first bore. The retention pin includes an aperture provided therein. The aperture is adapted to be axially aligned with respect to the second bore provided in the mounting bracket. The retention pin is adapted to engage the at least one recess provided on the wear element. The retention pin is adapted to limit longitudinal movement of the wear element within the groove. The mounting assembly further includes a lynch pin disposed in each of the second bore provided in the mounting bracket and the aperture provided in the retention pin. The lynch pin is adapted to limit axial movement of the retention pin within the at least one first bore.

In another aspect of the present disclosure, a blade assembly for a motor grader is provided. The blade assembly includes a blade adapted to engage a work surface. The blade assembly also includes a support member coupled to a circle member of the motor grader. The blade assembly further includes a mounting assembly coupled to each of the support member and the blade. The mounting assembly includes a mounting bracket adapted to be mounted to the support member. The mounting bracket includes a groove extending along a longitudinal axis of the mounting bracket. The mounting bracket also includes at least one first bore provided adjacent to the groove. The mounting bracket further includes a second bore provided adjacent to the at least one first bore. The mounting assembly includes a wear element disposed in the groove. The wear element includes at least one recess provided thereon. The at least one recess is adapted to be axially aligned with respect to the at least one first bore provided in the mounting bracket. The wear element is adapted to slidably receive a portion of the blade thereon. The mounting assembly also includes a retention pin disposed in the at least one first bore. The retention pin includes an aperture provided therein. The aperture is adapted to be axially aligned with respect to the second bore provided in the mounting bracket. The retention pin is adapted to engage the at least one recess provided on the wear element. The retention pin is adapted to limit longitudinal movement of the wear element within the groove. The mounting assembly further includes a lynch pin disposed in each of the second bore provided in the mounting bracket and the aperture provided in the retention pin. The lynch pin is adapted to limit axial movement of the retention pin within the at least one first bore.

In yet another aspect of the present disclosure, a motor grader is provided. The motor grader includes a frame. The motor grader includes a circle member mounted to the frame. The motor grader includes a pair of arms extending from the circle member. The motor grader includes a support member movably coupled to the pair of arms. The motor grader also includes a blade adapted to engage a work surface. The motor grader further includes a mounting assembly adapted to mount the blade to the support member. The mounting assembly includes a mounting bracket adapted to be mounted to the support member. The mounting bracket includes a groove extending along a longitudinal axis of the mounting bracket. The mounting bracket also includes at least one first bore provided adjacent to the groove. The mounting bracket further includes a second bore provided adjacent to the at least one first bore. The mounting assembly includes a wear element disposed in the groove. The wear element includes at least one recess provided thereon. The at least one recess is adapted to be axially aligned with respect to the at least one first bore provided in the mounting bracket. The wear element is adapted to slidably receive a portion of the blade thereon. The mounting assembly also includes a retention pin disposed in the at least one first bore. The retention pin includes an aperture provided therein. The aperture is adapted to be axially aligned with respect to the second bore provided in the mounting bracket. The retention pin is adapted to engage the at least one recess provided on the wear element. The retention pin is adapted to limit longitudinal movement of the wear element within the groove. The mounting assembly further includes a lynch pin disposed in each of the second bore provided in the mounting bracket and the aperture provided in the retention pin. The lynch pin is adapted to limit axial movement of the retention pin within the at least one first bore.

Other features and aspects of this disclosure will be apparent from the following description and the accompanying drawings.

DETAILED DESCRIPTION

Figure 1:
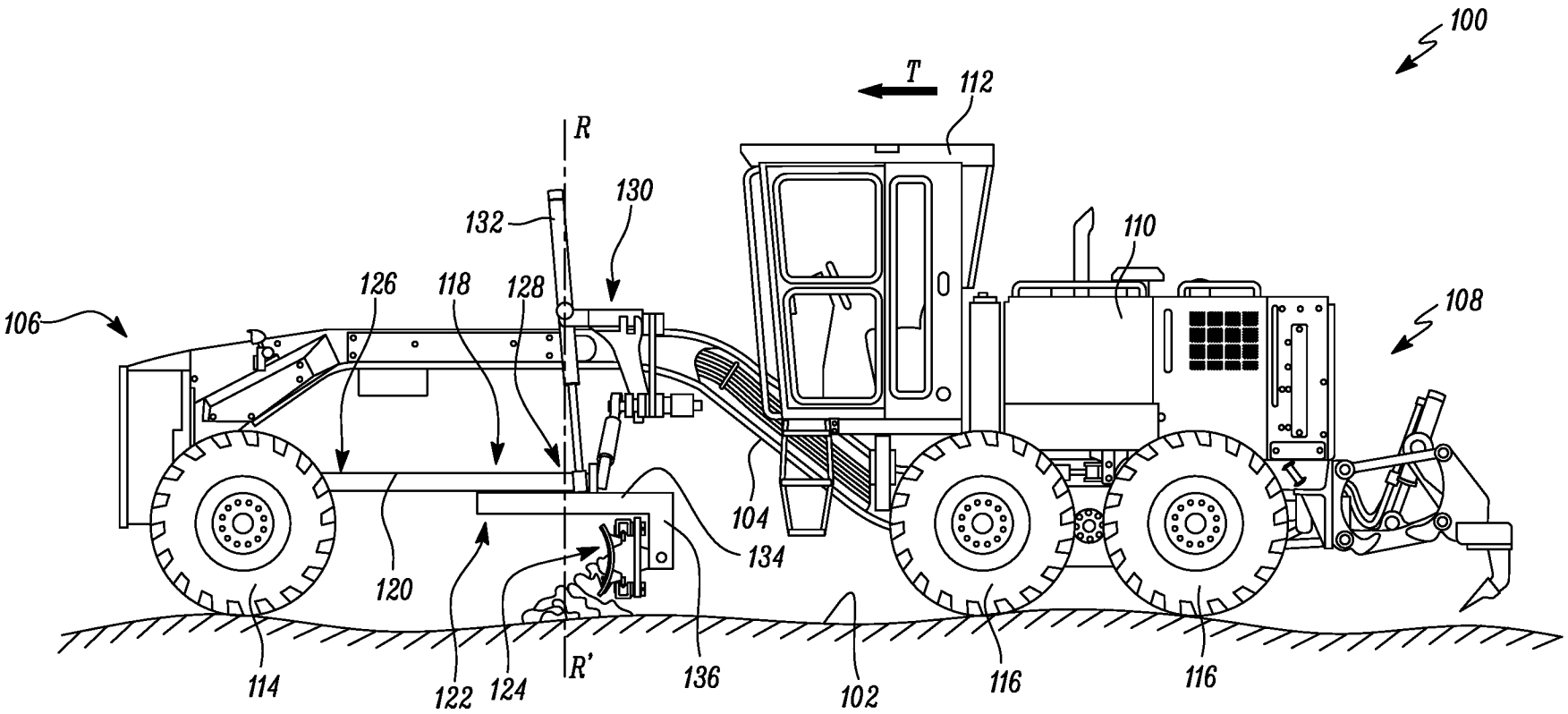
FIG. 1 is a side view of an exemplary motor grader, according to one embodiment of the present disclosure.

Wherever possible, the same reference numbers will be used throughout the drawings to refer to the same or the like parts. Referring to FIG. 1, a side view of an exemplary motor grader 100 is shown. The motor grader 100 may be used to displace, spread, distribute, level, and/or grade materials, such as soil, over a work surface 102 during a grading operation. The motor grader 100 includes a frame 104. The frame 104 defines a front end 106 and a rear end 108 with respect to a direction of travel "T" of the motor grader 100. The frame 104 supports one or more components of the motor grader 100. The motor grader 100 includes an enclosure 110 mounted on the frame 104. The enclosure 110 houses a power source (not shown), such as an engine, batteries, and the like, of the motor grader 100. The power source provides power to the motor grader 100 for operational and mobility requirements.

The motor grader 100 includes an operator cabin 112 mounted on the frame 104. The operator cabin 112 includes various controls (not shown), such as a steering, a joystick, an operator console, an operator seat, levers, pedals, buttons, switches, knobs, and the like. The controls are adapted to control the motor grader 100 on the work surface 102. The motor grader 100 includes a set of front wheels 114 and a set of rear wheels 116 rotatably mounted to the frame 104. Each of the front wheels 114 and the rear wheels 116 support and provide mobility to the motor grader 100 on the work surface 102.

The motor grader 100 includes a grader group 118 movably mounted to the frame 104. The grader group 118 is adapted to level and grade material over the work surface 102 during the grading operation. The grader group 118 includes a drawbar 120, a circle assembly 122, and a blade assembly 124. The drawbar 120 includes a first end 126 pivotally coupled to the front end 106 of the frame 104. The drawbar 120 includes a second end 128 movably coupled to a mid-portion 130 of the frame 104 via one or more actuators 132, such as a hydraulic actuator. The actuator 132 may be actuated to raise or lower the second end 128 of the drawbar 120 with respect to the frame 104, in turn, allowing the grader group 118 to be raised or lowered with respect to the work surface 102.

The circle assembly 122 includes a circle member 134 and a pair of arms 136. The circle member 134 rotates with respect to the drawbar 120 about a rotation axis R-R' of the circle member 134. The pair of arms 136 extend from the circle member 134 and rotate with a rotation of the circle member 134 with respect to the drawbar 120. Each of the pair of arms 136 is diametrically opposed and spaced apart from one another. Also, each of the pair of arms 136 extends from the circle member 134 in an axial direction along the rotation axis R-R'.

Figure 2:
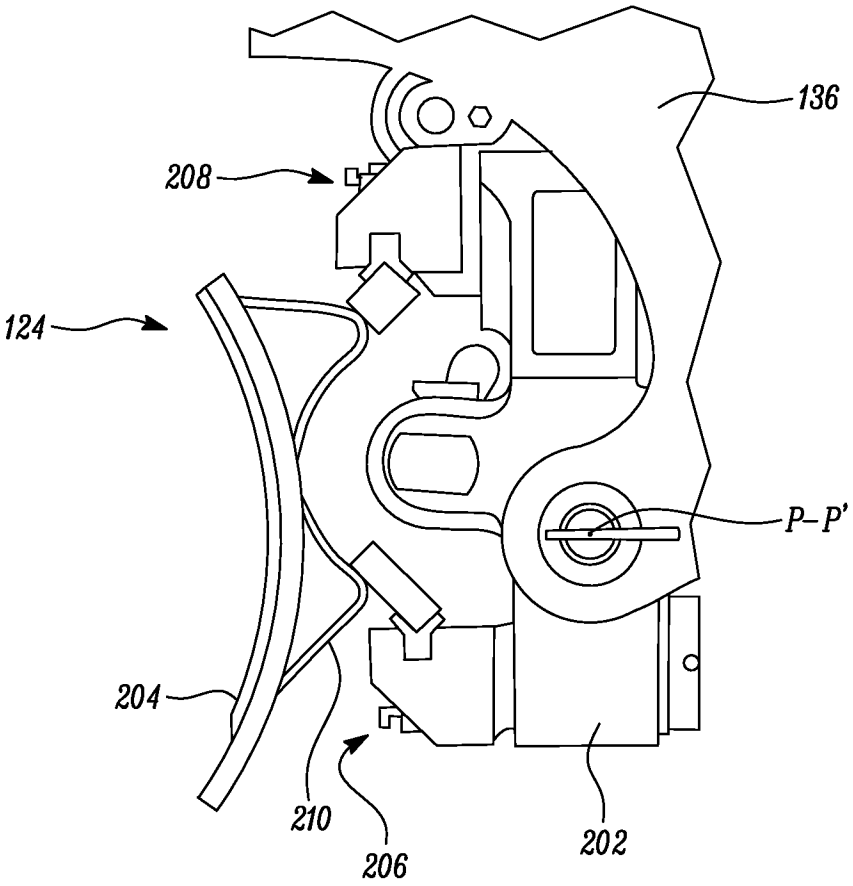
FIG. 2 is a side view of a blade assembly of the motor grader of FIG. 1, according to one embodiment of the present disclosure.

Referring to FIG. 2, the blade assembly 124 includes a support member 202, a blade 204, and a pair of mounting assemblies, such as a first mounting assembly 206 and a second mounting assembly 208. The blade assembly 124 is mounted to the pair of arms 136 via the support member 202. The support member 202 is movably coupled to the pair of arms 136, such that the support member 202 pivots about a pivot axis P-P' with respect to the frame 104. The blade 204 is mounted to the support member 202 via each of the first mounting assembly 206 and the second mounting assembly 208. As such, the blade 204 pivots about the pivot axis P-P' with respect to the frame 104. Also, the blade 204 slides along the pivot axis P-P' with respect to each of the first mounting assembly 206 and the second mounting assembly 208. The blade 204 engages the work surface 102 during the grading operation.

In the accompanying figure, a single first mounting assembly 206 and a single second mounting assembly 208 is shown. It should be noted that, the blade assembly 124 may include multiple first mounting assemblies and multiple second mounting assemblies, based on application requirements. In such a situation, each of the first mounting assemblies may be disposed longitudinally spaced apart with respect to one another along the pivot axis P-P' on the support member 202. Also, each of the second mounting assemblies may be disposed longitudinally spaced apart with respect to one another along the pivot axis P-P' on the support member 202. For purpose of clarity and explanation, the mounting assembly will now be explained with reference to the first mounting assembly 206. It should be noted that the second mounting assembly 208 has a configuration similar to a configuration of the first mounting assembly 206.

Figure 3:
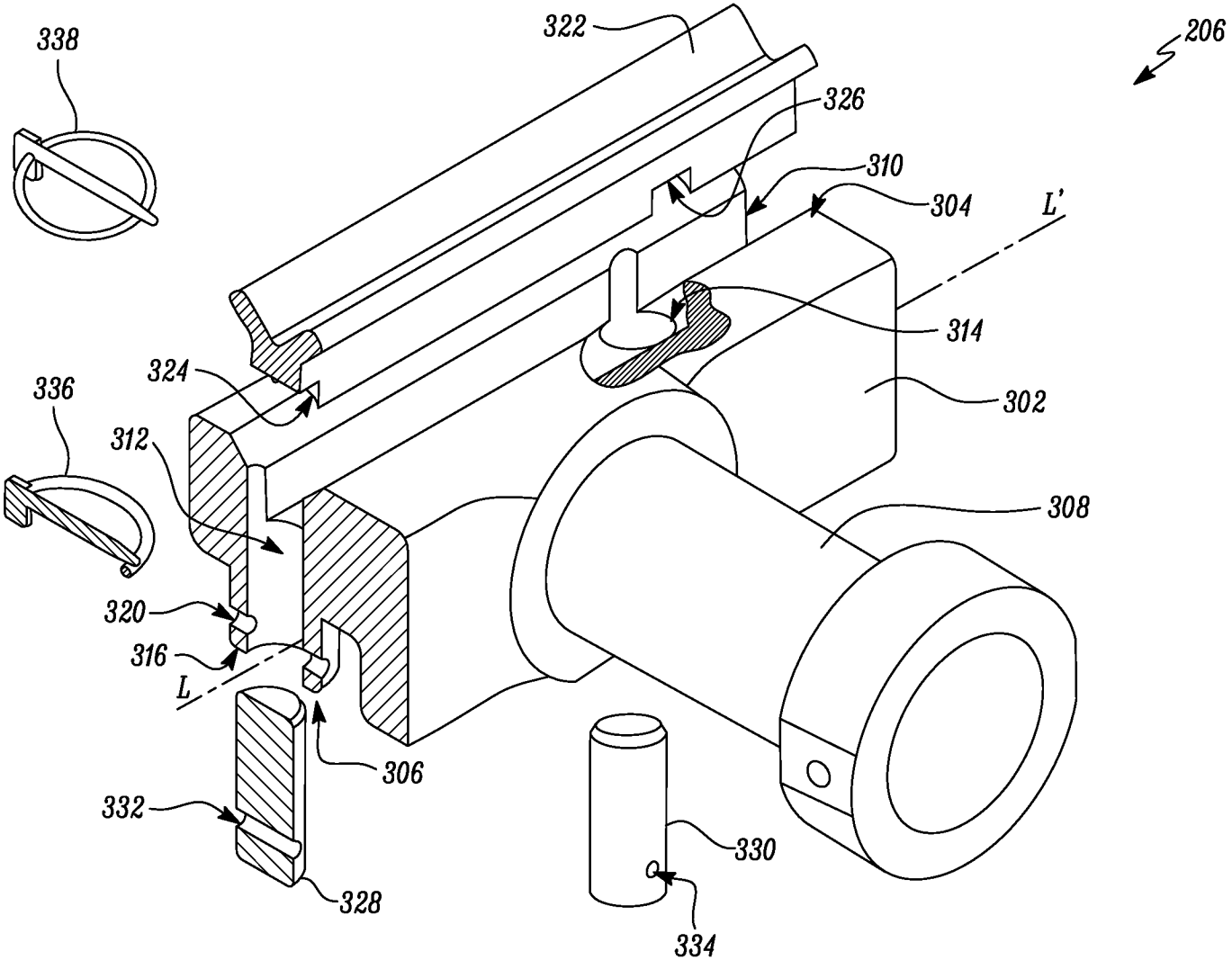
FIG. 3 is an exploded perspective cross-sectional view of a mounting assembly of the blade assembly of FIG. 2, according to one embodiment of the present disclosure.
Figure 4:
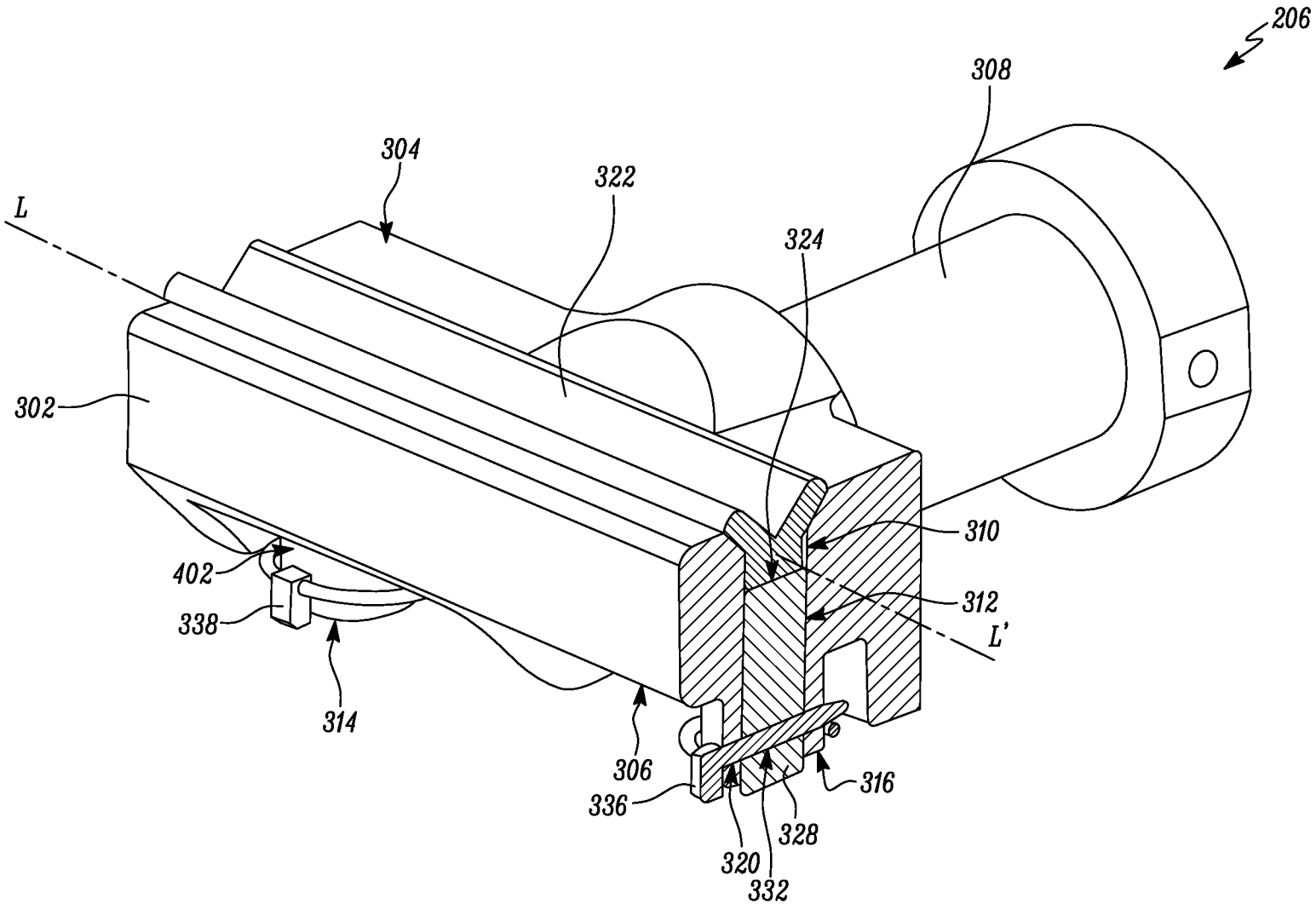
FIG. 4 is a perspective cross-sectional view of the mounting assembly of FIG. 3, according to one embodiment of the present disclosure.

Referring to FIGS. 3 and 4, different views of the first mounting assembly 206 are illustrated. The first mounting assembly 206 includes a mounting bracket 302. The mounting bracket 302 has a substantially elongated configuration defining a first side 304, a second side 306, and a longitudinal axis L-L'. The second side 306 is disposed opposite the first side 304. The mounting bracket 302 may be made of any material, such as metal, alloy, and the like. Also, the mounting bracket 302 may be manufactured using any manufacturing process, such as casting, forging, machining, additive manufacturing, and the like.

The mounting bracket 302 is adapted to be mounted to the support member 202. More specifically, in the illustrated embodiment, the mounting bracket 302 is mounted to the support member 202 using a mounting stem 308. The mounting stem 308 may be coupled to the mounting bracket 302 using any coupling method, such as welding or, in some cases, may be integrally formed with the mounting bracket 302 during manufacture of the mounting bracket 302. In other embodiments, the mounting bracket 302 may be directly coupled to the support member 202. In such a situation, the mounting stem 308 may be omitted.

The mounting bracket 302 includes a groove 310. More specifically, the groove 310 is provided on the first side 304 of the mounting bracket 302. The groove 310 extends along the longitudinal axis L-L' of the mounting bracket 302. In the illustrated embodiment, the groove 310 has a substantially Y-shaped cross-sectional configuration. In other embodiments, the groove 310 may have any other configuration, such as a V-shaped cross-sectional configuration, a U-shaped cross-sectional configuration, and the like. The mounting bracket 302 also includes a number of first bores 312, 314. More specifically, each of the first bores 312, 314 is provided on the second side 306 of the mounting bracket 302.

In the illustrated embodiment, the mounting bracket 302 includes two first bores 312, 314. Each of the first bores 312, 314 is disposed spaced apart with respect to one another along the longitudinal axis L-L'. Each of the first bores 312, 314 is provided in association with the groove 310. More specifically, each of the first bores 312, 314 is provided adjacent to and contacts the groove 310. Also, each of the first bores 312, 314 is disposed substantially perpendicular with respect to the groove 310. In the illustrated embodiment, each of the first bores 312, 314 has a substantially cylindrically configuration. In other embodiments, one or more of the first bores 312, 314 may have any other configuration, such as rectangular, triangular, and the like. Also, in other embodiments, the mounting bracket 302 may include single or multiple first bores, based on application requirements.

The mounting bracket 302 includes a number of extension portions 316, 402. More specifically, each of the extension portions 316, 402 is provided on the second side 306 of the mounting bracket 302 and opposite to the groove 310. Each of the extension portions 316, 402 is provided in association with each of the first bores 312, 314, respectively. More specifically, each of the first bores 312, 314 is provided through each of the extension portions 316, 402, respectively. In the illustrated embodiment, each of the extension portions 316, 402 has a substantially cylindrical configuration. In other embodiments, one or more of the extension portions 316, 402 may have any other configuration, such as rectangular. In the illustrated embodiment, the mounting bracket 302 includes two extension portions 316, 402 based on the number of first bores 312, 314. In other embodiments, the mounting bracket 302 may include single or multiple extension portions, based on the number of first bores.

The mounting bracket 302 includes a number of second bores 320 (only one shown in the accompanying figures) provided in the mounting bracket 302. Each of the second bores 320 is provided in each of the extension portions 316, 402, respectively. Each of the second bores 320 is provided adjacent to and contacts each of the first bores 312, 314, respectively. More specifically, each of the second bores 320 is disposed substantially perpendicular with respect to each of the first bores 312, 314, respectively.

The first mounting assembly 206 also includes a wear element 322. The wear element 322 is adapted to be disposed in the groove 310. In the illustrated embodiment, the wear element 322 has a substantially elongated and Y-shaped cross-sectional configuration. In other embodiments, the wear element 322 may have any other configuration, such as a V-shaped cross-sectional configuration, a U-shaped cross-sectional configuration, and the like. The wear element 322 includes a number of recesses 324, 326. Each of the recesses 324, 326 is disposed spaced apart with respect to one another. Each of the recesses 324, 326 is adapted to be axially aligned with respect to each of the first bores 312, 314, respectively.

In the illustrated embodiment, each of the recesses 324, 326 has a substantially cylindrical configuration, based on the configuration of each of the first bores 312, 314, respectively. In other embodiments, one or more of the recesses 324, 326 may have any other configuration, such as rectangular, triangular, and the like, based on the configuration of one or more of the first bores 312, 314, respectively. In the illustrated embodiment, the wear element 322 includes two recesses 324, 326. In other embodiments, the wear element 322 may include single or multiple recesses based on the number of first bores provided in the mounting bracket 302.

The wear element 322 is adapted to slidably receive a portion of the blade 204, such as a mounting rail 210 (shown in FIG. 2) of the blade 204. More specifically, the wear element 322 is adapted to provide a sacrificial wear surface between the mounting rail 210 of the blade 204 and the mounting bracket 302. Also, the mounting rail 210 limits lateral movement of the wear element 322 with respect to the longitudinal axis L-L' out of the groove 310. The wear element 322 may be made of any material, such as metal, alloy, and the like. The wear element 322 may be manufactured using any manufacturing process, such as casting, forging, machining, additive manufacturing, and the like.

The first mounting assembly 206 also includes a number of retention pins 328, 330. Each of the retention pins 328, 330 is disposed in each of the first bores 312, 314, respectively. In the illustrated embodiment, each of the retention pins 328, 330 includes a substantially cylindrical configuration, based on the configuration of each of the first bores 312, 314 and each of the recesses 324, 326, respectively. In other embodiments, each of the retention pins 328, 330 may have any other configuration, such as rectangular, triangular, and the like, based on the configuration of each of the first bores 312, 314 and each of the recesses 324, 326, respectively.

In an assembled position within each of the first bores 312, 314, each of the retention pins 328, 330 is adapted to engage each of the recesses 324, 326 provided on the wear element 322, respectively. As such, each of the retention pins 328, 330 is adapted to limit longitudinal movement of the wear element 322 within the groove 310 along the longitudinal axis L-L'. Each of the retention pins 328, 330 also includes an aperture 332, 334, respectively. Each of the apertures 332, 334 is disposed substantially perpendicular with respect to each of the first bores 312, 314, respectively. In the assembled position, each of the apertures 332, 334 is adapted to be axially aligned with respect to each of the respective second bores 320 provided in the mounting bracket 302. Each of the retention pins 328, 330 may be any pin used for locking applications.

The first mounting assembly 206 further includes a number of lynch pins 336, 338. Each of the lynch pins 336, 338 is disposed in each of the second bores 320 provided in the mounting bracket 302 and each of the apertures 332, 334 provided in each of the retention pins 328, 330, respectively. More specifically, each of the lynch pins 336, 338 is provided in and around each of the extension portions 316, 402, respectively, as shown in FIG. 4. In other embodiments, each of the lynch pins 336, 338 may be any other locking pin, such as a split pin, a cotter pin, a R-type pin, and the like. In the assembled position, each of the lynch pins 336, 338 is adapted to limit axial movement of each of the retention pins 328, 330 within each of the first bores 312, 314, respectively.

INDUSTRIAL APPLICABILITY

The present disclosure relates to the mounting bracket 302 for the blade 204 of the motor grader 100. During assembly of the wear element 322 on the mounting bracket 302, the wear element 322 is placed in the groove 310 provided in the mounting bracket 302, such that each of the recesses 324, 326 provided in the wear element 322 is aligned with respect to the respective first bores 312, 314 provided in the mounting bracket 302. Further, each of the retention pins 328, 330 is provided in the respective first bores 312, 314 provided in the mounting bracket 302. Each of the retention pins 328, 330 is disposed in the respective first bores 312, 314, such that each of the retention pins 328, 330 engages the respective recesses 324, 326. Accordingly, each of the retention pins 328, 330 limits longitudinal movement of the wear element 322 along the longitudinal axis L-L' within the groove 310.

Also, each of the retention pins 328, 330 is disposed in the respective first bores 312, 314, such that the respective apertures 332, 334 is aligned with respect to the respective second bores 320 provided in the mounting bracket 302. Further, each of the lynch pins 336, 338 is provided in the respective second bores 320 and the respective apertures 332, 334. Accordingly, each of the lynch pins 336, 338 limits axial movement of the respective retention pins 328, 330 within the respective first bores 312, 314. Each of the lynch pins 336, 338 is then folded around the respective extension portions 316, 402 in order to removably secure the respective lynch pins 336, 338 on the mounting bracket 302. Further, the mounting rail 210 of the blade 204 is placed on the wear element 322 in order to slidably mount the blade 204 on the first mounting assembly 206. Accordingly, the mounting rail 210 limits lateral movement of the wear element 322 with respect to the longitudinal axis L-L' out of the groove 310.

During disassembly or replacement of the wear element 322, each of the lynch pins 336, 338 is unfolded to unsecure each of the lynch pins 336, 338 with respect to the respective extension portions 316, 402. Each of the lynch pins 336, 338 is then disengaged from the respective second bores 320 provided in the mounting bracket 302 and the respective apertures 332, 334 provided in the respective retention pins 328, 330. Further, each of the retention pins 328, 330 is disengaged from the respective first bores 312, 314 and the respective recesses 324, 326. Further, the blade 204 is raised with respect to the mounting bracket 302 in order to disengage the mounting rail 210 from the wear element 322. The wear element 322 is then removed from the groove 310 provided in the mounting bracket 302. A new wear element 322 may then be replaced on the mounting bracket 302 in a manner as described above with reference to assembly of the wear element 322 on the mounting bracket 302.

The mounting assembly provides a simple, efficient, and cost-effective method of mounting the blade 204 on the frame 104 of the motor grade with the wear element 322. The mounting assembly provides improved visibility of the wear element 322, in turn, providing ease of inspection. The mounting assembly may include multiple retention pins and multiple lynch pins, based on an overall size of the mounting bracket 302 and/or the blade 204. As such, the multiple retention pins may provide improved retention of the wear element 322 on the mounting bracket 302, limit total loss of the sacrificial wear surface during failure of the wear element 322, and provide additional sacrificial wear surface area. The mounting assembly also provides improved working clearance around the blade assembly 124, in turn, providing improved access and serviceability.

The wear element 322 may be assembled and/or disassembled from the mounting bracket 302, as and when required, without use of any specialized tools and/or complete disassembly of the blade assembly 124. The wear element 322, each of the retention pins 328, 330, and each of the lynch pins 336, 338 may be simply slid in and out of respective locations on the mounting bracket 302, thus, providing, easy and tool less assembly/replacement. As such, the mounting bracket 302 reduces labor effort, reduces service time, reduces machine downtime, improves productivity, and improves overall costs. Also, the mounting assembly employs known and readily available components, such as the retention pins 328, 330, the lynch pins 336, 338, and the like, in turn, providing reduced complexity and improved compatibility. The mounting assembly may be retrofitted on any motor grader with little or no modification to the existing system.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of the disclosure. Such embodiments should be understood to fall within the scope of the present disclosure as determined based upon the claims and any equivalents thereof.

What is claimed is:

1. A mounting assembly for a blade of a motor grader, the mounting assembly comprising:

a mounting bracket adapted to be mounted to a frame of the motor grader, the mounting bracket including:

a groove extending along a longitudinal axis of the mounting bracket;

at least one first bore provided adjacent to the groove; and a second bore provided adjacent to the at least one first bore;

a wear element disposed in the groove, the wear element including at least one recess provided thereon, the at least one recess adapted to be axially aligned with respect to the at least one first bore provided in the mounting bracket, wherein the wear element is adapted to slidably receive a portion of the blade thereon;

a retention pin disposed in the at least one first bore, the retention pin including an aperture provided therein, the aperture adapted to be axially aligned with respect to the second bore provided in the mounting bracket, the retention pin adapted to engage the at least one recess provided on the wear element, wherein the retention pin is adapted to limit longitudinal movement of the wear element within the groove; and a lynch pin disposed in each of the second bore provided in the mounting bracket and the aperture provided in the retention pin, wherein the lynch pin is adapted to limit axial movement of the retention pin within the at least one first bore.

2. The mounting assembly of claim 1, wherein the at least one recess is at least one first recess provided on a first side of the wear element, and wherein the wear element is adapted to slidably receive the portion of the blade in a second recess on a second side of the wear element opposite the first side.

3. The mounting assembly of claim 1 wherein the wear element has opposing ends in a longitudinal direction that are entirely exposed when the wear element is disposed in the groove of the mounting bracket and the mounting bracket is mounted to the frame of the motor grader.

4. The mounting assembly of claim 2, wherein the lynch pin is provided in the extension portion.

5. The mounting assembly of claim 1, wherein the groove has a substantially Y-shaped cross-sectional configuration.

6. The mounting assembly of claim 1, wherein the wear element has a substantially Y-shaped cross-sectional configuration.

7. The mounting assembly of claim 1, wherein the at least one first bore is substantially perpendicular with respect to the groove.

8. The mounting assembly of claim 1, wherein the at least one first bore is substantially perpendicular with respect to each of the second bore and the aperture.

9. The mounting assembly of claim 1, wherein the portion of the blade slidably received on the wear element limits lateral movement of the wear element with respect to the groove.

10. The mounting assembly of claim 1, wherein the mounting bracket is mounted to the frame of the motor grader using a mounting stem and a support member.

11. A blade assembly for a motor grader, the blade assembly comprising:

a blade adapted to engage a work surface;

a support member coupled to a circle member of the motor grader; and a mounting assembly coupled to each of the support member and the blade, the mounting assembly including:

a mounting bracket adapted to be mounted to the support member, the mounting bracket including:

a groove extending along a longitudinal axis of the mounting bracket;

at least one first bore provided adjacent to the groove; and a second bore provided adjacent to the at least one first bore;

a wear element disposed in the groove, the wear element including at least one recess provided thereon, the at least one recess adapted to be axially aligned with respect to the at least one first bore provided in the mounting bracket, wherein the wear element is adapted to slidably receive a portion of the blade thereon;

a retention pin disposed in the at least one first bore, the retention pin including an aperture provided therein, the aperture adapted to be axially aligned with respect to the second bore provided in the mounting bracket, the retention pin adapted to engage the at least one recess provided on the wear element, wherein the retention pin is adapted to limit longitudinal movement of the wear element within the groove; and a lynch pin disposed in each of the second bore provided in the mounting bracket and the aperture provided in the retention pin, wherein the lynch pin is adapted to limit axial movement of the retention pin within the at least one first bore.

12. The blade assembly of claim 11, wherein the at least one recess is at least one first recess provided on a first side of the wear element, and wherein the wear element is adapted to slidably receive the portion of the blade in a second recess on a second side of the wear element opposite the first side.

13. The blade assembly of claim 1, wherein the wear element has opposing ends in a longitudinal direction that are entirely exposed when the wear element is disposed in the groove of the mounting bracket and the mounting bracket is mounted to the frame of the motor grader.

14. The blade assembly of claim 11, wherein the at least one first bore is substantially perpendicular with respect to the groove.

15. The blade assembly of claim 11, wherein the at least one first bore is substantially perpendicular with respect to each of the second bore and the aperture.

16. The blade assembly of claim 11, wherein the mounting bracket is mounted to the support member using a mounting stem.

17. A motor grader comprising:

a frame;

a circle member mounted to the frame;

a pair of arms extending from the circle member;

a support member movably coupled to the pair of arms;

a blade adapted to engage a work surface; and a mounting assembly adapted to mount the blade to the support member, the mounting assembly including:

a mounting bracket adapted to be mounted to the support member, the mounting bracket including:

a groove extending along a longitudinal axis of the mounting bracket;

at least one first bore provided adjacent to the groove; and a second bore provided adjacent to the at least one first bore;

a wear element disposed in the groove, the wear element including at least one recess provided thereon, the at least one recess adapted to be axially aligned with respect to the at least one first bore provided in the mounting bracket, wherein the wear element is adapted to slidably receive a portion of the blade thereon;

a retention pin disposed in the at least one first bore, the retention pin including an aperture provided therein, the aperture adapted to be axially aligned with respect to the second bore provided in the mounting bracket, the retention pin adapted to engage the at least one recess provided on the wear element, wherein the retention pin is adapted to limit longitudinal movement of the wear element within the groove; and a lynch pin disposed in each of the second bore provided in the mounting bracket and the aperture provided in the retention pin, wherein the lynch pin is adapted to limit axial movement of the retention pin within the at least one first bore.

18. The motor grader of claim 17, wherein the wear element has opposing ends in a longitudinal direction that are entirely exposed when the wear element is disposed in the groove of the mounting bracket, wherein the at least one recess is at least one first recess provided on a first side of the wear element, and wherein the wear element is adapted to slidably receive the portion of the blade in a second recess on a second side of the wear element opposite the first side.

19. The motor grader of claim 17, wherein the at least one first bore is substantially perpendicular with respect to the groove.

20. The motor grader of claim 17, wherein the at least one first bore is substantially perpendicular with respect to each of the second bore and the aperture.

* * * * *